United States Patent [19]

Jones, Jr. et al.

[11] Patent Number: 4,471,843

[45] Date of Patent: Sep. 18, 1984

[54] METHOD AND APPARATUS FOR ROTARY DRILL GUIDANCE

[75] Inventors: Emrys H. Jones, Jr., Butler, Pa.; Ronald W. Umphrey, Ponca City, Okla.

[73] Assignee: Conoco Inc., Ponca City, Okla.

[21] Appl. No.: 371,098

[22] Filed: Apr. 23, 1982

[51] Int. Cl.[3] ..... E21B 7/04

[52] U.S. Cl. ..... 175/73; 175/61; 175/62; 175/65

[58] Field of Search ..... 175/73, 61, 62, 65, 175/267

[56] References Cited

U.S. PATENT DOCUMENTS

| | | | |
|---|---|---|---|
| 2,316,409 | 4/1943 | Downing | 175/73 |
| 2,712,434 | 7/1955 | Giles | 175/73 |
| 3,554,302 | 1/1971 | Adkins | 175/267 |
| 3,595,326 | 7/1971 | Claycomb | 175/73 |
| 3,888,319 | 6/1975 | Bourne, Jr. et al. . | |
| 4,305,474 | 12/1981 | Farris | 175/73 |

FOREIGN PATENT DOCUMENTS

| | | | |
|---|---|---|---|
| 15137 | 3/1980 | European Pat. Off. | 175/73 |

OTHER PUBLICATIONS

"Rotary Drilling Holes in Coal Beds for Degasification," Bureau of Mines Report of Investigation 8097, U.S. Department of the Interior, 1975, Joseph Cervik et al.

*Primary Examiner*—William F. Pate, III

*Attorney, Agent, or Firm*—Richard W. Collins

[57] ABSTRACT

A process for controlling the direction of advance of a generally horizontal borehole extended through a subterranean coal-bearing formation by a rotary drilling operation. As the drill string is rotated in the hole, the advance of the drill bit is guided along a designated path by repeatedly deflecting the drill string from its axis in a constant radial direction. The drill string may also be centralized and the deflection operation carried out either within or outside of the drill-pipe segment between the bit and the centralizer. A deflection unit includes a plurality of deflector pads disposed about the periphery of a segment of the drill pipe. The deflector pads are cyclicly actuated to sequentially place each pad in an extended position at a constant rotational position of the drill pipe segment.

4 Claims, 6 Drawing Figures

METHOD AND APPARATUS FOR ROTARY DRILL GUIDANCE

TECHNICAL FIELD

This invention relates to rotary drilling unit guidance systems and more particularly to the drilling of boreholes through subterranean coal-bearing formations and methods and apparatus for controlling the advance of such boreholes.

BACKGROUND OF INVENTION

In the coal industry, it is a common expedient to form long, generally horizontal boreholes in coal-bearing formations in order to provide for the degasification of the coal formations prior to conducting mining activities. After drilling the boreholes, which are generally horizontal, i.e. generally follow the dip of the coal formation, they are vented to a suitable disposal or collection facility in order to remove hydrocarbon gas (methane) from the coal bed. It is usually desirable to drill relatively long gas-relief boreholes since the methane flow rates are directly proportional to their lengths. One difficulty encountered in drilling such holes is in maintaining the bit trajectory within the desired confines of the coal bed.

The systems employed in drilling gas-relief boreholes fall generally into two categories. In one case, the drill bit is rotated by means of a downhole drill motor which is either electrically or hydraulically powered. In the other case, the drill bit is driven by means of a rotating drill string which is connected to a suitable power source, such as a power swivel, located externally of the hole.

One useful system for controlling the directional advance of a hole drilled wherein power is supplied by means of a downhole drill motor is disclosed in U.S. Pat. No. 3,888,319 to Bourne et al. This system comprises a thrust unit, a roll control unit, a deflection unit, and the downhole drill motor. The downhole thrust unit includes a hold unit and a retraction unit, each comprising pressure feet which are adapted to be hydraulically forced against the side of the borehole to anchor the unit in place. The deflection unit comprises diametrically opposed pistons which are coupled together and are actuated by fluid pressure against the bias of a compression string to deflect the drill bit in one of two opposite directions. The roll control unit functions to orient the assembly at any desired angular displacement within the borehole. In operation, the assembly is anchored in the hole by means of the thrust unit and the drill bit advanced as it is rotated by the motor relative to the thrust unit. The orientation of the deflection unit is controlled by the roll control unit so that the appropriate piston can be biased against the side of the borehole to deflect the drill bit from the axis of the hole.

Bourne et al disclose various arrangements of the system components. In most cases, the deflection unit is located adjacent the drill bit. However, an alternative arrangement disclosed in Bourne et al involves locating a stabilizer adjacent the drill bit to centralize the assembly within the borehole. The deflection unit is then located behind the stabilizer so that actuation of the deflection unit causes the drill bit to pivot about the stabilizer. An alternative system disclosed in Bourne et al involves the use of a system having an external roll and power control unit which is connected to the downhole assembly by means of hollow drill pipes. The drill string is supported in the hole by means of a pair of longitudinally spaced stabilizers. The instrument package, drill motor and deflection unit are located between the front stabilizer and the drill bit.

The use of rotary drill string systems to drill gas relief holes is disclosed in Cervik, Joseph, et al. "Rotary Drilling Holes in Coal Beds for Degasification", Bureau of Mines Report of Investigation 8097, United States Department of the Interior, 1975. This report describes the use of various centralizer (stabilizer) configurations in combination with bit thrust and bit rotational velocity to control the bit trajectory. Thus, the authors disclose that by placing a short centralizer immediately behind the bit, the hole will follow a slight upward arc under the appropriate conditions of thrust on the drill string and rotational speed. By locating the centralizer about 10 feet behind the bit, the weight of the drill pipe and bit in front of the centralizer bends the drill string slightly downward and, consequently, the hole follows a curved path downward. Cervik et al also disclose the use of two centralizers, one directly behind the bit and the other spaced 10 to 20 feet behind the first centralizer. In this case, the borehole also follows a slightly downward path.

DISCLOSURE OF THE INVENTION

In accordance with the present invention there are provided new and improved borehole drilling processes and systems for controlling the deviation of a drill bit in the course of rotary drilling operations. One embodiment of the invention involves a process for drilling a generally horizontal borehole through a subterranean coal-bearing formation with a rotary drill string having a drill bit at the end thereof. The drill string is centralized in the borehole at a first location behind the drill bit. The advance of the drill bit is guided along a designated path by means of a deflection operation carried out at a second location spaced longitudinally along the drill string from the drill bit and from the centralizer location. The deflection operation involves repeatedly deflecting the drill string from its axis in a constant radial direction during the rotation of the drill string.

In a further aspect of the invention, there is provided a drill guidance system for a rotary drilling unit. The guidance system comprises an elongated barrel member adapted to be inserted into a borehole as a segment of the drill string. The drill pipe segment is provided with a deflector array. This array comprises a plurality of deflector pads disposed about the periphery of the barrel member at circumferentially spaced locations. The system is further provided with means for cyclically actuating the deflector pads between projected and retracted positions to sequentially place each of the deflector pads in a projected position at a constant rotational position of the drill pipe segment.

BEST MODES FOR CARRYING OUT THE INVENTION

Figure 1:
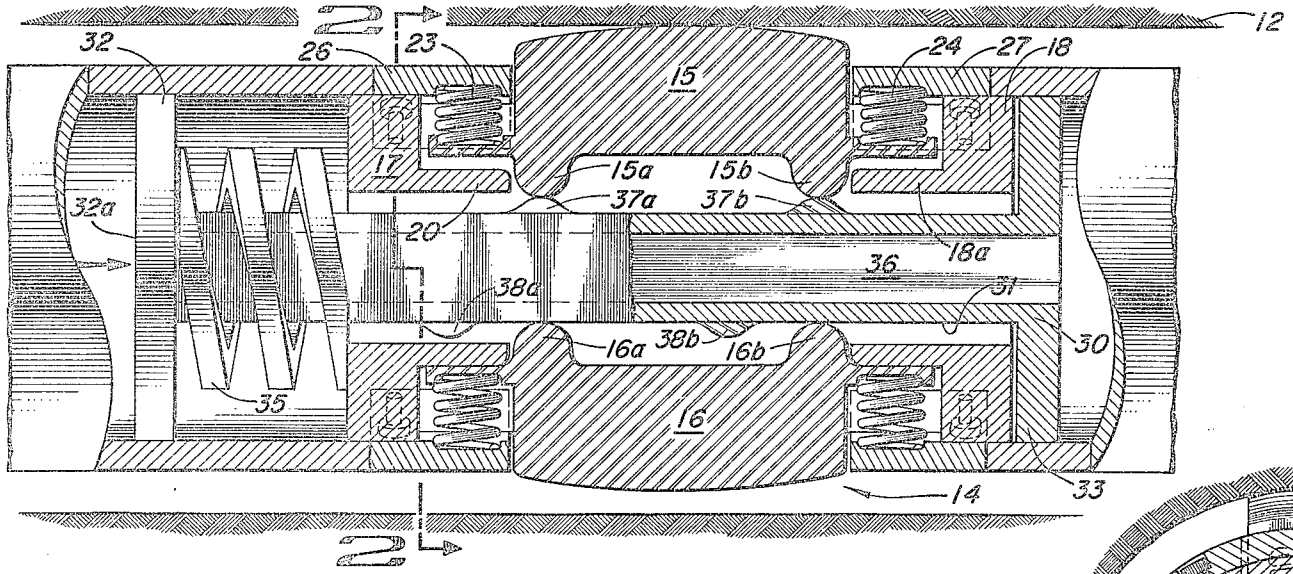
FIG. 1 is a side elevation, partly in section, of a drill guidance deflector unit embodying the present invention.

In rotary drilling operations, axial and rotational forces are imparted to the drill bit through a string of drill pipe which extends from the bit to the surface of the borehole. A drilling fluid is circulated through the well in order to remove cuttings therefrom. This is accomplished by pumping the drilling fluid into the borehole through the rotating drilling string and outwardly through ports in the drill bit. The drilling fluid is then forced out of the well through the annulus surrounding the drill string. The drill cuttings are entrained in the drilling fluid and are withdrawn from the well with the fluid. The drilling fluid in addition to serving as a vehicle for the removal of cuttings, may also serve other functions such as cooling of the drill bit. Water normally is employed as the drilling fluid in such operations.

In the drilling of gas relief holes preparatory to coal mining operations, the holes follow the dip of the coal bed and thus are oriented in a generally horizontal direction. In this configuration, the weight of the drill pipe provides little or no weight on the bit. The axial thrust on the bit and the rotational force are provided by means of an external prime mover. This may be of any suitable form such as the drill and power units described in the previously referred to Report of Investigations by Cervik et al. Typically, the axial thrust imposed upon the bit may range from about 500 to 3,000 pounds. The bit normally is rotated at a rate of about 200 to 1,000 revolutions per minute.

The present invention provides several improvements in rotary drilling systems and deflection units which are particularly well suited for use in drilling generally horizontal gas-relief holes through coal-bearing formations. In one aspect of the invention there is provided the combination of a rotary drill string and drill bit having a stabilizer unit mounted in the drill string behind the drill bit. The stabilizer unit functions to centralize the drill string within the borehole. A deflection unit is also mounted in the drill string at a location spaced from the stabilizer. The deflector unit functions to deflect the drill string from its axis at a constant rotational position as the drill string is rotated. Thus the drill bit can be deflected from the axis of the borehole along any azimuth or pitch. The deflector unit may be positioned between the stabilizer unit and the drill bit or it may be positioned on the remote side of the stabilizer unit relative to the bit, depending upon the desired mode of employing the deflector unit to cause the drill bit to deviate from the axis of the hole. Where the deflector is located intermediate the stabilizer and drill bit, it may be placed in close proximity to the drill bit in order to provide for a relatively rapid change in direction of the hole upon operation of the deflector unit.

In a further aspect of the invention there is provided an improved deflector unit which is useful in the above described or other rotary drilling systems. The deflector unit comprises an elongated barrel member equipped with a deflector array. The deflector array comprises first and second deflector pads which are mounted on the wall of the barrel member at opposed sides thereof. An expansion mandrel is slidably disposed in the barrel member and extends through the deflector array. The expansion mandrel is equipped with first and second cam means which are adapted to engage the first and second deflector pads, respectively. Upon such engagement, the pads are projected outwardly to an extended position. The first and second cam means are spaced longitudinally along the expansion mandrel so that as the mandrel is reciprocated within the barrel member, the cam means sequentially contact the deflector pads. The deflector pads are biased inwardly to a retracted position by means of suitable biasing means.

Figure 2:
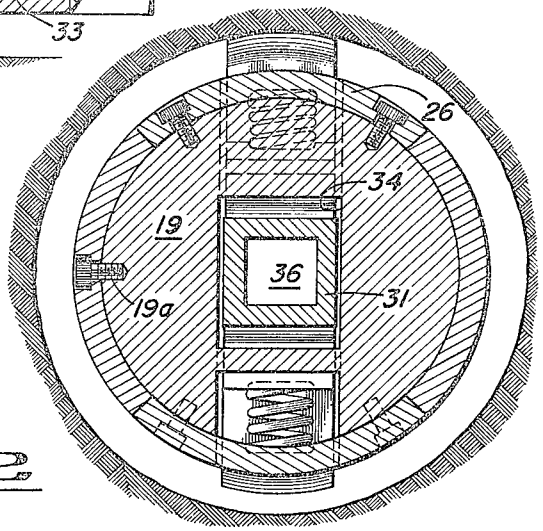
FIG. 2 is a cross-sectional view taken along line 2—2 of FIG. 1.

Turning now to FIG. 1 of the drawings, there is illustrated a side elevational view, partly in section, of a hydraulically actuated deflection unit embodying the present invention. The deflection unit comprises a tubular barrel member which is shown positioned within a borehole 12. The barrel member 11 is provided with suitable tool joint connections (not shown) at its ends so that it can be connected in the drill string as a segment thereof. The deflector unit further comprises a deflector array 14 which, in the embodiment shown, comprises first and second deflector pads 15 and 16, respectively, which are mounted about the periphery of the member 11 in a diametrically opposed relationship. As shown in FIG. 1 and as also shown in the exploded view provided by FIG. 3, the deflector pads fit within retainer members 17 and 18 which are formed at each end of a receptacle 19. For example, with respect to deflector pad 15, retainer members 17 and 18 are provided with abutment ledges **17*a* and 18*a*, respectively, which are adapted to receive flanges 20 and 21 of pad 15. Compression springs 23 and 24 are mounted between flanges 20 and 21 and cover plates 26 and 27 which are bolted to the receptacle members. The deflector pads 15 and 16 are provided by inwardly projecting shoulders 15*a* and 15*b* and 16*a* and 16*b*, respectively, which are adapted to be engaged by longitudinally spaced cam surfaces as described below. The receptacle assembly is secured within the barrel member by suitable fastener means such as the screw 19*a* shown in FIG. 2**.

The deflector unit further comprises an expansion mandrel 30 which is slidably disposed within barrel member 11 and is adapted to be actuated by pulsating fluid flow through the drill string. The expansion mandrel includes a central tubular member 31 and flanges 32 and 33. Flange 32 provides an active piston surface **32*a* and flange 33 abuts against the front surface of retaining member 18 to limit the rearward movement of the expansion mandrel. The mandrel is biased to the rearward direction by means of compression spring 35 interposed between flange 32 and the rear surface of retainer 17. The central portion 31 of the expansion mandrel is rectangular in cross section and conforms generally to the cross section of the channel 34 which extends through the receptable assembly, thus preventing rotation of the mandrel relative to the pads. A central passage 36** extends through the expansion mandrel and provides for the flow of drilling fluid therethrough.

The expansion mandrel 30 is provided with first cam means for actuation of deflector pad 15 and second longitudinally spaced cam means for actuation of deflector pad 16. The cam means for deflector pad 15 comprises protruding cam surfaces **37*a* and 37*b* which are adpated to engage shoulders 15*a* and 15*b*, respectively. The projections 37*a* and 37*b* are spaced the same distance as shoulders 15*a* and 15*b* so that the shoulders are contacted simultaneously by the corresponding cam surfaces. Thus deflecting pad 15, upon actuation by mandrel 30, is moved outwardly evenly throughout its length. The cam means for the second pad 16 takes the form of spaced, projecting cam surfaces 38***a* and 38*b* which are adapted to simultaneously engage shoulders 16*a* and 16*b*, respectively.

From an examination of FIG. 1, it can be seen that under static conditions, i.e., no fluid flow through the drill string, the expansion mandrel 30 will be in the position shown and the deflecting pad 15 will be in the projected or expanded position. As fluid flow through the drill string is increased to a point where the force against the active surface 32*a* of piston head 32 is greater than the compressive force of spring 35, the expansion mandrel 30 is moved forwardly. The initial forward movement of mandrel 30 permits the force of compression springs 23 and 24 to retract deflector pad 15 and it, as well as pad 16, is then in the retracted position. Upon additional forward movement of the expansion mandrel, cam surfaces 38*a* and 38*b* engage shoulders 16*a* and 16*b* and cause pad 16 to move outwardly to the expanded position. Upon a decrease in the flow rate through the drill string, and consequently the force imposed upon surface 32*a*, the expansion mandrel is moved to the rear under the bias of spring 35 with the consequent retraction of pad 16 and subsequent outward projection of pad 15.

From the foregoing description it will be recognized that pads 14 and 15 can be cyclically projected and retracted by imposing a pulsating fluid flow through the drill pipe in which the deflection unit is located. In the present invention such pulsating fluid flow is synchronized with rotation of the drill string so that each of the deflector pads 15 and 16 is placed in the expanded position at a constant rotational position of the barrel member. Thus, during operation of the rotary drilling unit, fluid flow through the drilling string may be varied between a minimum rate, at which the pads are in the position shown in FIG. 1, and a maximum rate at which mandrel 30 is driven forward to reverse the position of the pads 15 and 16. The frequency of the pulsating fluid flow is equal to the rate of rotation of the drill string and is phased such that the deflection pads are sequentially projected outwardly at the angular displacement of the drill pipe which results in deflection of the bit in the desired direction. As described hereinafter, the pads are moved outwardly to the projected position at the angle of the desired radial direction of deviation or 180° out-of-phase therewith depending upon the position of the deflection unit in the drill string.

Any suitable technique may be employed for flowing the drilling fluid through the drill string in a pulsating mode in synchronization with rotation of the drill string. A preferred technique for controlling the fluid flow through the drill string to effect actuation of the deflector pads is disclosed in U.S. Pat. Application Ser. No. 371,097 entitled Rotary Drill Indexing System filed of even date herewith by Emrys H. Jones and Ronald W. Umphrey. As disclosed in the Jones and Umphrey application, the fluid flow through the drill string is pulsed in a sinusoidal format at a frequency equal to the frequency of rotation of the drill pipe by means of a recirculation circuit. The recirculation circuit is operated in response to rotation of the drill string and is indexed with the drill string to provide the maxima and minima of flow rate at the appropriate angular displacement for deflection of the drill string in the desired direction. For a more detailed description of the means for imposing a pulsating fluid flow through the drill string, reference is made to the Jones and Umphrey application Serial No. 371,097, which is incorporated herein by reference.

Figure 3:
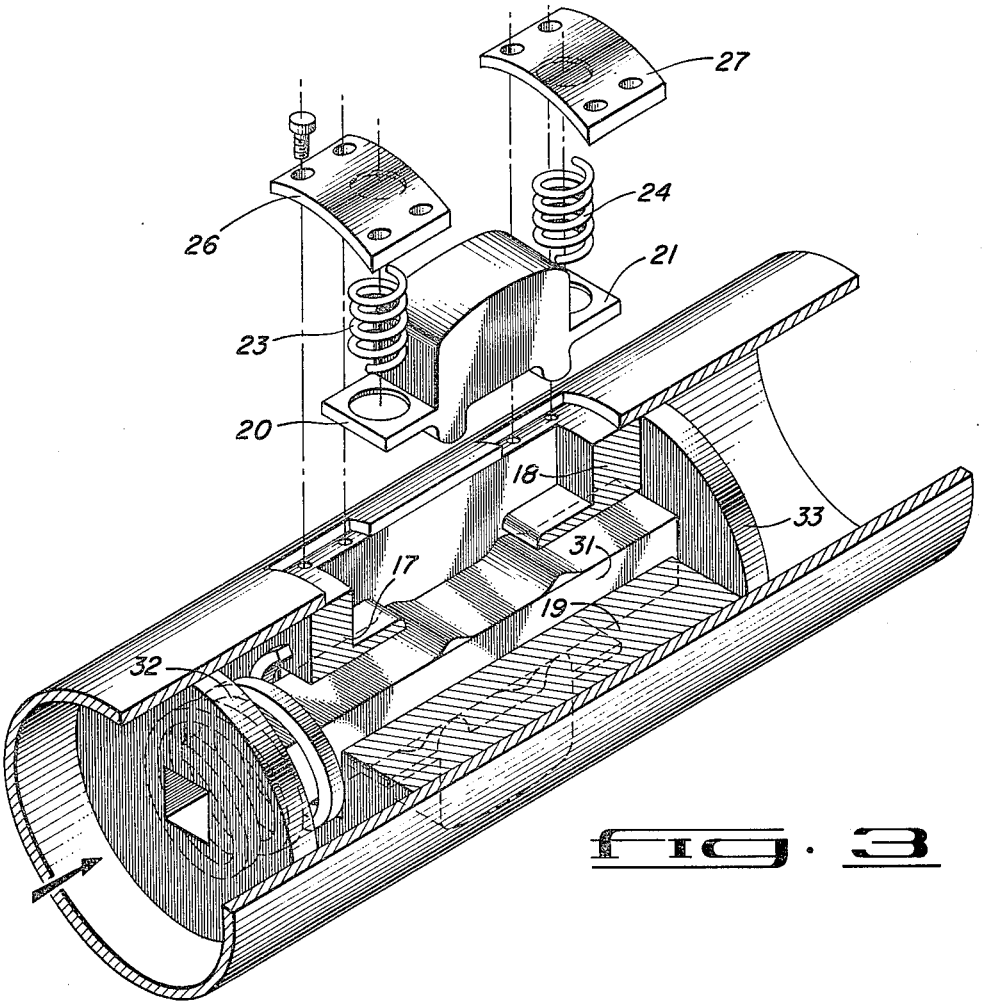
FIG. 3 is an exploded perspective view, with parts broken away, of the system of FIG. 1.

In the embodiment illustrated in FIGS. 1 and 3, the position of the stop flange 33 relative to cam surfaces 37*a* and 37*b* is such that deflection pad 15 is always in the expanded position under conditions of no fluid flow or low fluid flow which produces a force against the piston head 32 which is less than the force imposed by compression spring 35. This offers the advantage of providing a relatively broad tolerance range for the pressure required to move the expansion mandrel to the forward position for extension of pad 16. It will be recognized that this configuration will not permit both deflection pads to be in the retracted position during static conditions such as encountered during withdrawal and insertion of the drilling unit within the borehole. As an alternative to the arrangement illustrated, the expansion mandrel can be extended to move the flange 33 forward so that, in the rearmost position of the expansion mandrel, cam surfaces 37*a* and 37*b* are moved out of contact with shoulders 15*a* and 15*b* respectively. In this case, the compression spring 35 would move the expansion mandrel to a position in which both pads are in the retracted position when there is no pressure on surface 32*a*.

The present invention may be carried out employing the deflection unit in various configurations in the rotary drill string. Since the deflection operation is carried out cyclically with rotation of the bit, it can simply be inserted in the drill string without the need to provide for relative rotational movement of the bit or for anchoring means in the hole while the bit is advanced. In this case the deflection unit may be connected in the drill string within a few feet of the bit and the deflection pads operated so that they are extended at an angle of 180° from the desired direction of deflection.

Figure 4:
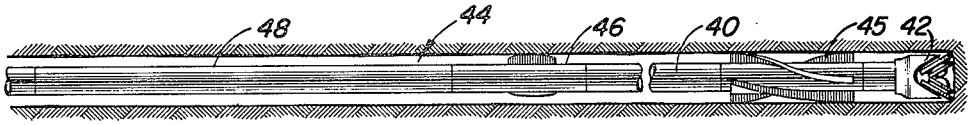
FIG. 4 is an illustration of a drill string incorporating a guidance system in accordance with the present invention.
Figure 5:
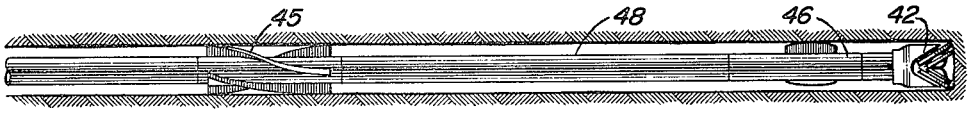
FIG. 5 is an illustration of a drill string incorporating another embodiment of the invention.
Figure 6:
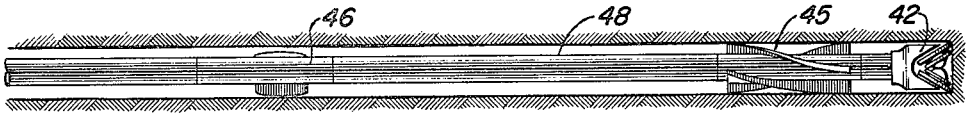
FIG. 6 is an illustration of a drill string incorporating yet a further embodiment of the invention.

In a further aspect of the invention, the deflector unit is employed in combination with a stabilizer unit which functions to centralize the drill string within the hole. Several embodiments of the invention employing this combination are illustrated in FIGS. 4, 5, and 6. Turning first to FIG. 4, there is shown a borehole 40 which is drilled through a coal seam by means of a drill bit 42 secured to the end of a rotary drill string 44. A stabilizer unit 45 is located immediately behind the drill bit and a deflector unit 46 is located behind the stabilizer unit. The stabilizer may be comprised of one or more centralizers, such as those disclosed in the aforementioned article by Cervik et al. Typically the stabilizer section will comprise a centralizer having a diameter slightly less than the diameter of the drill bit. For example, where the drill bit is a 3½" bit the centralizer may have a diameter of 3⅜ to 3 7/16". The spacing between the deflection unit 46 and the centralizer 45 may vary depending upon the desired bit-trajectory angle in response to operation of the deflection unit. Where the deflection unit is in a close proximity to the centralizer, operation of the unit will cause the hole to deviate rather sharply. If a shallower angle of deviation is desired, the deflection unit should be spaced a greater distance from the centralizer.

In the configuration shown in FIG. 4 the drill bit will be deflected along the same direction as the displacment angle at which the deflection pads are extended. Thus, in the embodiment of FIG. 4, the deflection unit is operated to project the pads upwardly, as viewed in the drawing. The drill string is forced downwardly at the deflection unit and the drill bit is deflected upwardly as the drill string is pivoted about centralizer 45.

An alternative embodiment in which the deflection unit is located between the drill bit and the stabilizer section is illustrated in FIG. 5 in which the drill bit, deflection unit, and stabilizer unit are designated at the same reference numerals as employed in FIG. 4. In this case, the drill bit will be deflected in a direction displaced 180° from the angle at which the deflection pads are moved to the extended position. Thus, operation of the deflection unit to project the deflection pads upwardly as viewed in the drawing will force the drill bit along a downward trajectory. In this embodiment, it will usually be preferred to place the deflection unit in closer proximity to the drill bit than to the stabilizer unit in order to sharpen the angle at which the hole is deflected.

The embodiments of the invention illustrated in FIGS. 4 or 5 will accommodate the use of a singleshot survey instrument. The survey instrument can be of any suitable type adapted to measure the vertical coordinate (pitch) of the borehole axis, the horizontal coordinate (azimuth), or both. In many cases, it will only be necessary to measure the pitch which can be done by means of a gravity operated inclinometer. Where it is desired to measure azimuth, this may be accomplished with a tool comprising suitable means such as a magnetic or gyroscopic compass. When it is desired to determine the orientation of the borehole to determine whether corrective procedures should be employed, the singleshot survey tool is pumped through the drill string to a suitable seat (not shown) located in tubing joint 48. When the tool is seated in the drill string, it records the measured parameter. Thereafter the tool may be retrieved by means of a wire line and the appropriate corrective procedures taken. The use of such surveying instruments and their installation and retrieval are well known to those skilled in the art as disclosed, for example, in the aforementioned report of investigations by Cervik et al.

Yet a further embodiment of the invention is disclosed in FIG. 6 in which like elements are designated by the same reference numerals as used in FIGS. 4 and 5. In this embodiment of the invention, tool joint 48, which is designed to accommodate an in-place survey tool, is located in close proximity to the drill bit. In this case, the surveying instrument is located immediately behind the stabilizer 45 and in front of the deflection unit 46. Since the stabilizer unit is located between the bit and the deflection unit, operation of the deflection unit to extend the pads in a given direction will result in deflection of the drill bit in the same direction, similarly as in the case of FIG. 4. However, the angle of deflection of the drill bit in response to operation of the deflection unit will be somewhat shallower than in the case of FIG. 4.

In the embodiment of FIG. 6, the orientation of the hole can be determined continuously or intermittently by the in-line survey tool and the measured parameters telemetered to the surface of the hole by any suitable technique. For example, signals representative of the pitch and azimith coordinants can be transmitted to the surface of the hole by means of an electrical conductor provided in the drill string or by means of acoustic signals transmitted to the surface via the drilling fluid circulated through the hole.

In each aspect of the invention described thus far, deflection of the drill pipe is accomplished utilizing a unit consisting of two diametrically opposed deflection pads. This type of configuration usually will be preferred from the standpoint of reliability and simplicity of operation. Thus as noted previously with respect to FIG. 1, actuation of the pads can be accomplished by varying the fluid flow through the drill string in a sine wave relationship so that a pad is extended each time the drill string is rotated through an arc of 180°. It is to be recognized, however, that various other configurations can also be employed in carrying out the invention. For example, the deflection unit could take the form of three pads spaced from one another by 120° or by two sets of diametrically opposed pads to provide an angular displacement between pads of 90°.

Having described specific embodiments of the present invention, it will be understood that modifications thereof may be suggested to those skilled in the art, and it is intended to cover all such modifications as fall within the scope of the appended claims.

What is claimed is:

1. In a drill guidance system for a rotary drilling unit the combination comprising:

(a) an elongated barrel member adapted to be inserted into a borehole as a segment of drill pipe, (b) a deflector array comprising first and second deflector pads mounted in the wall of said barrel member at opposed sides thereof, (c) an expansion mandrel slidably disposed in said barrel member and extending through said deflector array, (d) first and second cam means on said mandrel adapted to engage said first and second deflector pads, respectively, to project said pads outwardly to an extended position, said first and second cam means being spaced longitudinally along said mandrel whereby said cam means engage said deflector pads sequentially as said mandrel is reciprocated within said barrel member, and (e) biasing means for biasing said deflector pads inwardly to a retracted position.

2. The combination of claim 1 further comprising a fluid passage extending longitudinally through said expansion mandrel to provide for fluid flow through said barrel member, an active piston surface on said mandrel exposed to the interior of said barrel member whereby an increase in fluid pressure within said barrel member moves said expansion mandrel forward relative to said deflector array, and biasing means for biasing said expansion mandrel away from said deflector array upon a decrease in pressure within said barrel member.

3. The combination of claim 2 wherein each of said first and second cam means comprises a plurality of longitudinally spaced cam surfaces on said expansion mandrel adapted to engage conforming shoulders spaced longitudinally on the corresponding deflection pad.

4. The combination of claim 3 further comprising means for securing said mandrel against rotation relative to said deflector pads.

* * * * *